United States Patent [19]

Evans et al.

[11] Patent Number: 4,501,992

[45] **Date of Patent: * Feb. 26, 1985**

[54] ENERGY CONSERVING INSTANT-START SERIES-SEQUENCE FLUORESCENT LAMP SYSTEM AND FLUORESCENT LAMP WITH OVERCURRENT PROTECTION

[75] Inventors: George S. Evans, Caldwell; Edward W. Morton, Teaneck; John F. Gilmore, deceased, late of Verona; by Roderick A. Gilmore, Administrator, West Orange, all of N.J.

[73] Assignee: North American Philips Lighting Corp., New York, N.Y.

[ * ] Notice: The portion of the term of this patent subsequent to Jun. 22, 1999 has been disclaimed.

[21] Appl. No.: 410,763

[22] Filed: Aug. 23, 1982

Related U.S. Application Data

[63] Continuation-in-part of Ser. No. 300,319, Sep. 8, 1981, Pat. No. 4,435,670.

[51] Int. Cl.[3] ..... H05B 37/00

[52] U.S. Cl. ..... 315/122; 315/119; 315/106; 315/74; 315/58

[58] Field of Search ..... 315/58, 71, 74, 106, 315/119, 121, 122, 187, 228, 231, 239, 240

[56] References Cited

U.S. PATENT DOCUMENTS

| | | | |
|---|---|---|---|
| 3,954,316 | 5/1976 | Luchetta | 315/96 |
| 3,956,665 | 5/1976 | Westphal | 315/95 |
| 4,010,399 | 3/1977 | Bessone et al. | 315/101 |
| 4,082,981 | 4/1978 | Morton et al. | 315/97 |
| 4,163,176 | 7/1979 | Cohen et al. | 315/53 |

*Primary Examiner*—David K. Moore

[57] ABSTRACT

An energy-saving instant-start series-sequence fluorescent lamp system includes power-reducing capacitor means connected in series circuit arrangement with one or both lamps in a two-lamp system. A protective device is connected in circuit with a first lamp of the system so that in the event the second lamp fails to operate and causes a high current to flow through the first lamp, the protective device reacts to prevent the system from being damaged. A lamp incorporating the power-reducing capacitor and protective device is also disclosed.

12 Claims, 7 Drawing Figures

ENERGY CONSERVING INSTANT-START SERIES-SEQUENCE FLUORESCENT LAMP SYSTEM AND FLUORESCENT LAMP WITH OVERCURRENT PROTECTION

This application is a continuation-in-part of Application Ser. No. 300,319, filed Sept. 8, 1981, now U.S. Pat. No. 4,435,670 issued Mar. 6, 1984 and owned by the present assignee.

CROSS-REFERENCE TO RELATED APPLICATION

In copending Application Ser. No. 300,347, filed Sept. 8, 1981, and owned by the present assignee, is disclosed an energy-saving instant-start series-sequence fluorescent lamp system including an energy reduction capacitor means connected in series-circuit with lamps of the system. The energy reduction capacitor means is housed within the stem member cavity means of the lamps to provide a uniform appearance and to facilitate retrofit application into existing systems.

BACKGROUND OF THE INVENTION

This invention relates to energy-saving fluorescent lamp systems and, more particularly, to a lamp system having a built-in protective device for preventing overcurrent current in the case a particular one of the two-lamp system fails to operate.

In recent years, substantial effort and development has been expended in reducing the energy consumed by existing fluorescent lamp systems. A number of devices have been disclosed for accomplishing this purpose. One such device is disclosed in U.S. Pat. No. 3,954,316, dated May 4, 1976, to Luchetta. This patent describes an attachment for inclusion in a two-lamp rapid-start fluorescent lamp circuit. It comprises an isolation transformer and a capacitor to reduce the electrical power consumption of the lamps. The capacitor is placed in series with the existing power factor correcting capacitor in the standard rapid-start ballast and this reduces the power consumption. The isolation transformer provides heater current for one of the electrodes in one of the lamps and also functions to improve power factor.

Another energy savings device is disclosed in U.S. Pat. No. 3,956,665, dated May 11, 1976 to Westphal. This patent discloses an energy saving device for replacing a fluorescent lamp in a two-lamp serially connected fluorescent fixture. This device permits the use of one of two lamps of a two-lamp system by substituting a capacitor for one of the lamps.

U.S. Pat. No. 4,082,981, dated Apr. 4, 1978 to Morton discloses an energy saving device for a rapid-start series-sequence type ballast for fluorescent lamps. The apparatus utilizes a switch in conjunction with a capacitor to limit the current supplied to the lamps after the lamps are initially energized. U.S. Pat. No. 4,163,176 dated July 31, 1979 to Cohen et al. discloses an instant-start fluorescent lamp and elongated extension base which houses a capacitance for reducing current flow through the lamp. U.S. Pat. No. 4,010,399, dated Mar. 1, 1977 to Bessone et al. discloses a switching circuit for a fluorescent lamp with heated filaments. The switching circuit can be held within one stem member cavity of the fluorescent lamp.

SUMMARY OF THE INVENTION

The lamp of the present invention operates in combination with an instant-start series-sequence fluorescent lamp system includes a pair of input terminal means for connecting the system to a power source. The pair of fluorescent lamps each comprise an elongated tubular vitreous envelope enclosing a discharge-sustaining filling and carrying phosphor on the inner surface of the envelope. Vitreous re-entrant stem presses are sealed to each end portion of the envelope and each form cavity means at the envelope ends. The stem presses have lead-in conductors sealed therethrough which operatively support electrodes within the envelope proximate each end portion thereof. The system includes a transformer means which includes a primary winding, a secondary winding and an auxiliary winding. A first of the lamps has one of its electrodes in circuit between one of the apparatus input terminals and one end of the primary winding. The other of the electrodes of the first lamp is in circuit with a point which is common to one end of the secondary winding and one end of the auxiliary winding. The second of the lamps has one of its electrodes in circuit between the other of the input terminals and the other end of the primary winding. The other of the electrodes of the second lamp is in circuit with the other end of the secondary winding and the other end of the auxiliary winding is in circuit with one end of the primary winding. A ballast capacitor is connected in circuit between the common point and the other electrode of the first lamp.

The improvement comprises a first power-reducing capacitor in series circuit with the first lamp and a second power-reducing capacitor in series circuit with the second lamp. A protective device connects in circuit with the first power-reducing capacitor and is responsive to a predetermined increase in the system operating current through the first power-reducing capacitor in order to perform one of the following functions: (1) the electrical circuit to the first power-reducing capacitor is opened in order to disable the system, at least momentarily, or (2) the first power-reducing capacitor is electrically shunted, and the protective device serves to protect the system from overload conditions which can be encountered upon failure of the second lamp of the system.

The retrofit fluorescent lamp which is specially adapted to operate in such a system incorporates the power-reducing capacitor as well as the protective device within at least one of the re-entrant stem cavity means.

BRIEF DESCRIPTION OF THE DRAWINGS

For a better understanding of the invention, reference may be had to the preferred embodiments, exemplary of the invention, shown in the accompanying drawings, in which.

DESCRIPTION OF THE PREFERRED EMBODIMENTS

Figure 1:
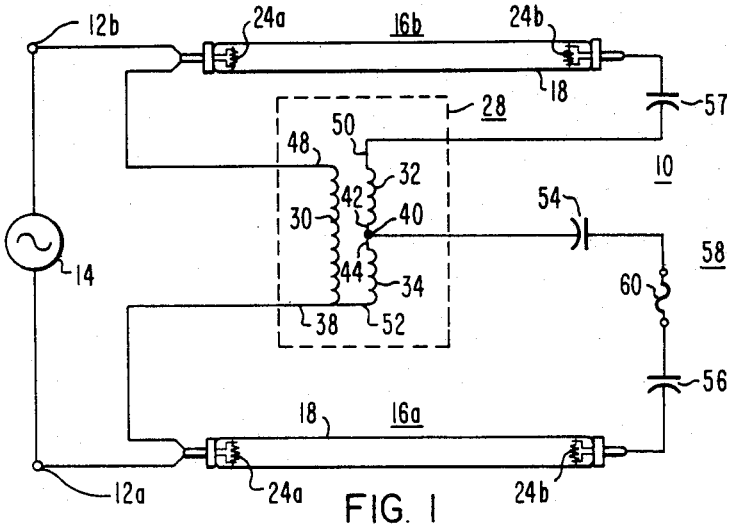
FIG. 1 is a schematic diagram showing an instant-start series-sequence fluorescent lamp system which is modified to incorporate power-reducing capacitor means and a fusible protective device.

In FIG. 1 is shown an instant-start series-sequence fluorescent lamp system 10. The basic patent describing such a system is U.S. Pat. No. 2,558,293, dated June 19, 1951 to Feinberg. Such fluorescent lamp systems are commonly used to operate 96 inch (244 cm.) fluorescent lamps in applications such as grocery stores wherein a high starting voltage is required to initiate lamp operation. The system 10 includes a pair of input terminal means 12*a*, 12*b* for connecting the system to a power source 14. The system includes a pair of fluorescent lamp means 16*a*, 16*b* each comprising an elongated tubular vitreous envelope 18 enclosing a discharge-sustaining environment and filling, typically a small charge of mercury and a small charge of inert gas, such as argon, which facilitates starting.

Figure 4:
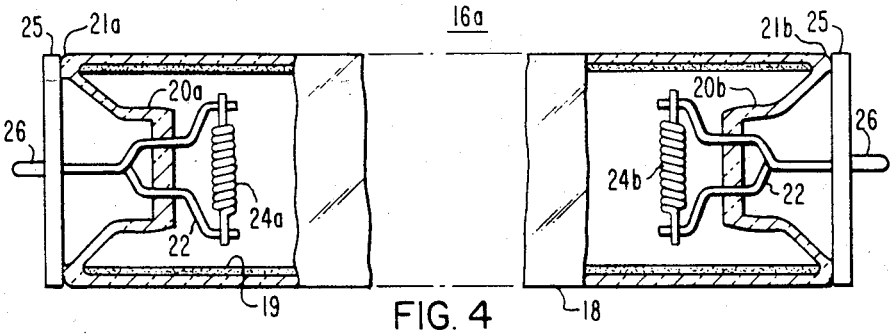
FIG. 4 PRIOR ART
FIG. 4 is a sectional elevation, partly broken away, illustrating a conventional prior art instant-start fluorsecent lamp.

The conventional lamp is shown in greater detail in FIG. 4 wherein the envelope 18, typically made of glass, carries a phosphor layer 19 on the inner surface thereof. Substantially hollow vitreous re-entrant stem presses 20*a*, 20*b* are sealed to each end porion 21*a*, 21*b* of the envelope 18. Each stem press 20*a*, 20*b* has lead-in means 22 sealed therethrough and opertively supporting electrodes 24*a*, 24*b* within the envelope 18 proximate each end portion thereof. End caps 25 are sealed to each envelope end portion and each end cap 25 supports a single contact member 26 for energizing the lamps in the system 10 and the lead-ins 22 electrically connect to the single contact members 26.

Referring again to FIG. 1, the system 10 includes a transformer means 28 which includes a primary winding 30, a secondary winding 32 and an auxiliary winding 34. A first of the lamp means 16*a* has one of the electrodes 24*a* in circuit between one of the input terminals 12*a* and one end 38 of the primary winding 30. The other of the electrodes 24*b* of the first lamp 16*a* is in circuit with a point 40 which is common to one end 42 of the secondary winding 32 and one end 44 of the auxiliary winding 34. The second of the lamps 16*b* has one of the electrodes 24*a* in circuit between the other of the input terminals 12*b* and the other end 48 of the primary winding 30. The other of the electrodes 24*b* of the second lamp 16*b* is in circuit with the other end 50 of the secondary winding 32. The other end 52 of the auxiliary winding 34 is in circuit with one end 38 of the primary winding. A ballast capacitor means 54 is in circuit between the common point 40 and the other electrode 24*b* of the first lamp 16*a*. Typically the transformer 28 is a step-up autotransformer. The ballast capacitor means 54 is typically encased in a packaged device with the transformer 28.

In operation, the electrodes 24*a*, 24*b* of the lamps means 16*a*, 16*b* are not preheated, but are started by application of very high voltage. Typically, the auxiliary winding 34 provides about 565 volts to start the first lamp 16*a*. The voltage across the second lamp 16*b* is the vector sum of the primary, auxiliary and secondary voltages, with the auxiliary voltage out-of-phase and, therefore, subtracting from the sum of the other two, resulting in about 200 volts applied across the second lamp 16*b* before the first lamp 16*a* starts. When the first lamp 16*a* starts and current flow begins, the voltage across the ballast capacitor 54 causes the phase angle of the auxiliary voltge to shift, causing it to add to the primary and secondary voltages thus starting the second lamp 16*b*. The typical operating voltage for an F96 T12 lamp is about 200 volts rms, with a normal operating current of 430 mA rms. Thus the normal ballast output is about 430 mA at 400 volts. The instant-start series-sequence fluorescent lamp system as described thus fas is generally conventional.

In order to reduce the power consumed by the two-lamp instant-start circuit, power-reducing capacitors 56 and 57 are included in series circuit with each of the first lamp 16*a* and the second lamp 16*b* and these capacitors are conveniently located in the stem portion of the lamp in order to permit a retrofit design. With such an arrangement, the lamp current can be substantially reduced. For example, utilizing a ballast manufactured by Universal Manufacturing Corporation designated No. 806-BR, which is the equivalent of the transformer 28 and the ballast capacitor 54, as shown in FIG. 1, if both added capacitors 56 and 57 have a value of 4 microfarads, the total power consumed by the lamp system 10 can be reduced to 60% of the rated power of the system.

It has been found, however, that the transformer 28 may be damaged if the second lamp 16*b* does not start or fails during operation or if the second power-reducing capacitor 57 in series circuit therewith fails during operation. In either case, a current will flow through the first lamp 16*a* and through the auxiliary winding 34 and the power-reducing capacitor 56. In the lamp system 10 which does not utilize the power-reducing capacitors 56 and 57, with standard F96 T12 lamps both operating, the circulating current in the auxiliary winding 34 is about 50 mA. Failure of the second lamp 16*b* causes the circulating current in the auxiliary winding 34 to increase to about 200 mA and the transformer 28 will experience a rise in temperature under such conditions, but will not be damaged. With the inclusion of the energy reducing capacitor 56, however, the circuit impedance is reduced and failure of the second lamp 16*b* or the second power reducing capacitor 57 causes the circulating current to increase in the auxiliary winding 34 to a value of about 400 mA. If this circulating current of 400 mA is permitted to continue, the auxiliary winding 34 may overheat and burn out and the transformer 28 will have to be replaced.

Following are test data which illustrate the current variations which can be encountered upon failure of one of the lamps, both with and without the additional power-reducing capacitors.

| 2-LAMP SERIES BALLAST, 120 VOLTS | | | |
|---|---|---|---|
| Operating Condition | Current, Milliamperes 1st Lamp | 2nd Lamp | Voltage Across Energy Reducing Capacitor 56 |
| 2-96 T12 lamps both on, No capacitor | 412 | 395 | No capacitor |
| Second lamp out, same as above | 192 | 0 | No capacitor |
| 2-96 T12 lamps, 2-4.0 Mfd. capacitors, both lamps on | 190 | 214 | 128 rms |
| Same as above, second lamp out | 402 | 0 | 236 rms |

As shown in the foregoing table, with the second lamp **16*b* being not functioning, current through the first lamp 16*a* is about twice normal current and the voltage across the power-reducing capacitor 56 is also about twice the normal voltage. This increase in the voltage across the power-reducing capacitor 56** can also lead to its premature failure.

In accordance with the present invention, the system is protected from failure of the lamp **16*b* by including a protective device 58 in circuit with the power-reducing capacitor 56. Broadly, the protective device 58 is included in circuit with the first power-reducing capacitor 56 and is responsive to a predetermined increase in the system operating current through this capacitor in order to perform one of the following functions: (1) the electrical circuit to the power-reducing capacitor 56 is opened or (2), the protective device electrically shunts the capacitor 56**.

Figure 5:
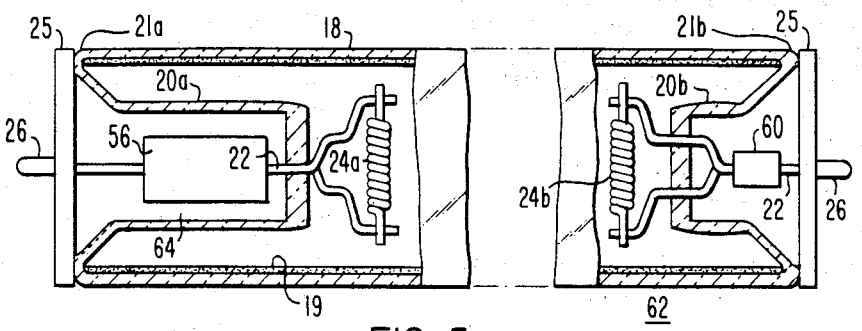
FIG. 5 is a sectional elevation, partly broken away, illustrating a fluorescent lamp which is modified in accordance with the present invention to incorporate an elongated stem cavity which houses a power-reducing capacitor at one end and a fusible member at the other end.

Referring to the system embodiment and the corresponding lamp embodiment as shown in FIGS. 1 and 5, the system is modified to incorporate a protective device 58 which in the form shown in FIGS. 1 and 5 comprises a fusible member or link 60 which is included in series circuit with the power reducing capacitor 56. In the lamp embodiment as shown in FIG. 5, the modified lamp 62 has one of the hollow vitreous stem presses elongated to form a stem press cavity 64 in which the power-reducing capacitor 56 is incorporated. The other end of the lamp is modified only to incorporate the fusible member 60 in lead-in 22. This fusible member 60 is essentially in series circuit with the power-reducing capacitor 56 when the lamp is normally operating and it is responsive to a predetermined current overload such as 400 mA to fuse and render the lamp 62 inoperative, in order to prevent damage to the ballast apparatus. It should be clear that the fusible member 60 could also be included in the same hollow stem cavity 64 as the power-reducing capacitor 56.

Figure 2:
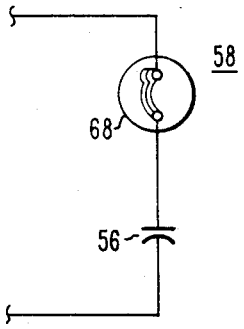
FIG. 2 is a partial schematic diagram corresponding to FIG. 1, but illustrating a modified protective device which is formed as a current-responsive resettable device.
Figure 6:
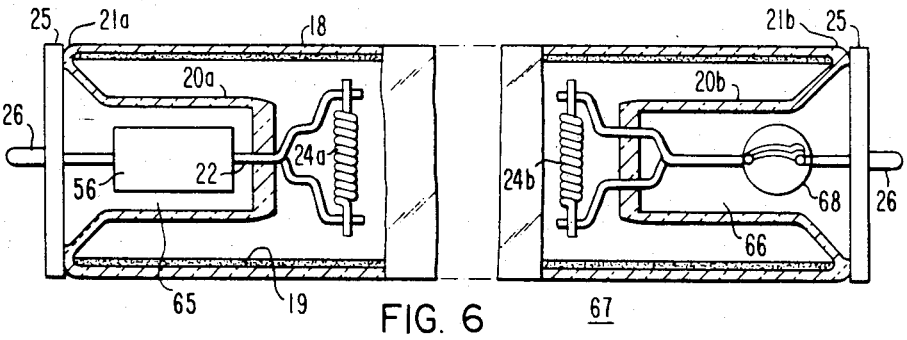
FIG. 6 is a sectional elevation, partly broken away, of a fluorescent lamp of the present invention wherein both ends of the lamp incorporate modified stem cavities with the power-reducing capacitor connected at one end thereof and a thermally responsive member connected at the other end thereof.

In the partial circuit diagram as shown in FIG. 2 and the corresponding lamp embodiment as shown in FIG. 6, the hollow vitreous re-entrant stem press cavity means 65 and 66 at both ends of the modified lamp 67 are both enlarged somewhat and the protective device is formed as a bimetal switch 68 which is responsive to excessive current through the capacitor 56 in order to open the series circuit and then, after a predetermined period of time has elapsed, to automatically close the series circuit. In this embodiment, the bimetal switch arrangement 68 is included at the opposite end of the lamp from the capacitor 56. This bimetal switch has certain advantages since in the circuit embodiment as shown in FIG. 1, which utilizes a fusible element 60, once the element has fused in response to the detection of a fault, the lamp containing the fuse will normally have to be replaced. This fuse arrangement is also susceptible to the problem that even in the event of a momentary fault condition, which would not necessarily be damaging to the system components, the fuse 60 will open permanently, thereby requiring lamp replacement.

The current responsive element 68 as shown in FIGS. 2 and 6 also has the feature that it can be designed to automatically reset after a predetermined period of time, such as one or two minutes. An element which functions very satisfactorily in such a circuit is marked by GTE-Sylvania under the designaion "Thermo-Protector" style ESB701-2800 bimetal. Such a device responds to fault conditions by producing excessive current heat and the element contains a heat-responsive bimetal blade which is prestressed in order to give a snap-action opening effect. The device is glass enclosed and gas-filled, in order to provide maximum thermal response and minimum arc suppression for longer contact life. Once the bimetal cools down, it snaps back to its original closed position and the circuit again operates, but only for a short period of time if the overload condition still remains. This has the additional advantage that the lamp turns on and off whenever an overcurrent fault has been detected and is sustained, and this provides the added benefit of alerting maintenance personnel of a defective condition. In the event of a temporary-type overload condition, however, such as can occur with lightning surges, power surges, itc., the foregoing automatic reset device 68 can respond to this momentary condition and protect the circuit and then automatically reset itself, permitting normal operation to continue. While the device 68 as shown in the embodiment in FIG. 6 has been placed at the opposite end of the lamp from the power-reducing capacitor 56, both of these elements could be included within the same elongated re-entrant stem press cavity if desired.

Figure 3:
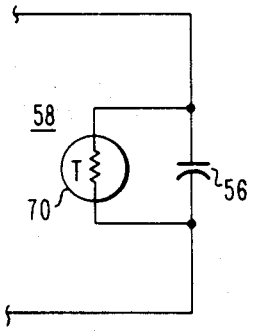
FIG. 3 is a partial schematic diagram corresponding to FIG. 1, but illustrating a modified switch device which is voltage-responsive and which connects in parallel with the power-reducing capacitor.
Figure 7:
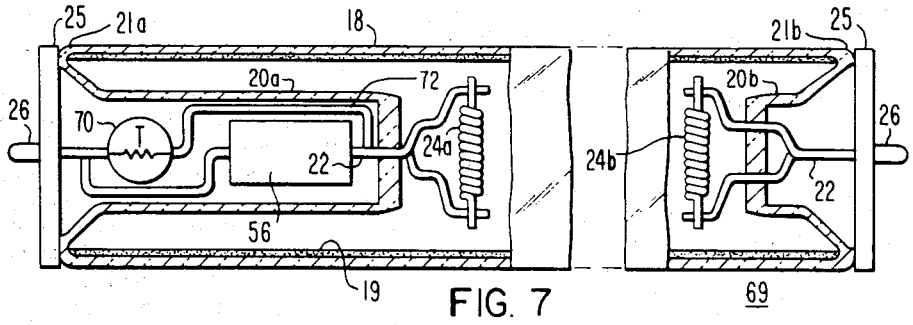
FIG. 7 is a sectional elevation, partly broken away, illustrating a fluorescent lamp modified in accordance with the present invention wherein a power reducing capacitor and parallel-connected voltage responsive switch are housed within an elongated stem cavity at one end of the modified lamp.

In the circuit embodiment as shown in FIG. 3 and the corresponding lamp embodiment 69 as shown in FIG. 7, the protective device 58 is modified so that it responds to the increased voltage developed across the capacitor 56 which results from a current increase therethrough because of a fault condition. A preferred form for such a device is a thermistor 70 connected in parallel by lead-in 72 with power reducing capacitor 56. The thermistor 70 can have a variety of different designs and a thermistor as manufactured by Keystone Carbon Company Model NORL34F3, having a rating of about 7 watts, which will respond to a voltage of 180 volts rms to conduct current and bypass the capacitor 56, has been found to be very satisfactory. This thermistor 70 will display a high impedance when the system is operating normally, but when it switches to a conductive state, it effectively removes the power-reducing capacitor means 56 from circuit by short-circuiting same. In any of these embodiments, the system is protected from damage upon failure of a lamp.

As a further alternative embodiment, a glow switch type device such as those designated FS-4 can be connected across the capacitor 56 and designed so as to breakdown only when the normal operating voltge range of the power-reducing capacitor 56 is exceeded. With such a glow switch, the bimetal within the switch can be designed to be held permanently in the shorting position by a locking feature once the glow switch breaks down.

The lamp embodiments as shown in FIGS. 5, 6 and 7 are all similar in that they are retrofit fluorescent lamps which are adapted for operation in the instant-start series-sequence two-lamp system. In these embodiments, at least one of the substantially hollow vitreous re-entrant stem presses protrude into the space within the envelope to form a cavity means of predetermined size and shape, with the re-entrant stem press cavity means being sealed from the environment within the envelope. Whether the protective devices 60 and 68 are positioned at the same end of the envelope as the power reducing capacitor 56 or at the opposite end is immaterial since in either case, these protective devices are in series circuit with the power-reducing capacitor 56 when the lamp is normally operating. In the case of the thermistor 70 or glow switch, however, each of which are responsive to the increased voltage developed across the power-reducing capacitor 56 because of the increased current therethrough, the protective devices 70 should be located within the same cavity as the power-reducing capacitor 56.

For a F96 T12 lamp, the stem press which is adapted to receive the capacitor 56 preferably has a length of about 3 inches (7.62 cm) and an inside diameter of about 0.673 inch (1.7 cm) to accommodate the power reducing capacitor 56 and, if desired, the protective device. A typical power reducing capacitor has a tubular configuration with a maximum diameter of 0.59 inch (1.5 cm) and a maximum length of about 1.87 inches (4.75 cm). The protective devices can vary in size depending upon the device construction used. In the case of a simple fusible member 60, it can be placed into a conventional stem press cavity without alteration of same, such as the embodiment shown in FIG. 5. The other types of protective devices, however, normally require some additional space.

The foregoing lamp and system is subject to considerable design variations. Utilizing 3.3 microfarad capacitors for the power reducing capacitors 56 and 57, together with a fusible member, a fuse which is rated at 300 mA provides excellent performance. With similar 3.3 microfarad capacitors, the previously designated thermistor provides excellent performance.

What we claim is:

1. In combination with an instant-start series-sequence fluorscent lamp system including a pair of input terminal means for connecting said system to a power source, a pair of fluorescent lamp means each comprising an elongated tubular vitreous envelope enclosing a discharge-sustaining filling and carrying phosphor means on the inner surface thereof, substantially hollow vitreous re-entrant stem presses sealed to each end portion of said envelope and having lead-in means sealed therethrough and operatively supporting electrodes within said envelope proximate each end portion thereof, transformer means including a primary winding, a secondary winding and an auxiliary winding, a first of said lamp means having one of said electrodes in circuit between one of said input terminal means and one end of said primary winding, the other of said electrodes of said first lamp means in circuit with a point common to one end of said secondary winding and one end of said auxiliary winding, the second of said lamp means having one of said electrodes in circuit between the other of said input terminals and the other end of said primary winding, the other of said electrodes of said second lamp means in circuit with the other end of said secondary winding, the other end of said auxiliary winding in circuit with said one end of said primary winding, and ballast capacitor means in circuit between said common point and said other electrode of said first lamp means, the improvement which comprises:

a first power-reducing capacitor means of predetermined capacitance in series circuit with said first lamp means and a second power-reducing capacitor means of predetermined capacitance in series circuit with said second lamp means, and protective device means in circuit with said first power-reducing capacitor means and responsive to a predetermined increase in the system operating current through said first power-reducing capacitor means to effectively remove from circuit said first power-reducing capacitor means, whereby said lamp system is protected from overload conditions encountered upon failure of said second lamp means.

2. In a fluorescent lamp system according to claim 1, said protective device comprising means for opening the electrical circuit to said first power-reducing capacitor means.

3. In a fluorescent lamp system according to claim 2, said protective device comprising a current-responsive fusible element in series with said first power-reducing capacitor means and responsive to an excessive current for opening the electrical circuit to said first power-reducing capacitor means.

4. In a fluorescent lamp system according to claim 2, said protective device comprising a current-responsive element in series with said first power-reducing capacitor means and responsive to an excessive current for opening the electrical circuit to said first power-reducing capacitor means and for automatically closing the circuit after a predetermined period of time has elapsed.

5. In a fluorescent lamp system according to claim 1, said protective device comprising means for electrically shunting said first power-reducing capacitor means.

6. In a fluorescent lamp system according to claim 5, said protective device comprising a voltage-responsive switching element connected in parallel with said first power-reducing capacitor means and which normally has a high impedance when said lamp system is operating properly, and which is responsive to a predetermined increased voltage developed across said first power-reducing capacitor means to switch to a low impedance state to shunt and effectively remove said first power-reducing capacitor means from circuit.

7. A retrofit fluorescent lamp adapted for operation in an instant-start series-sequence two lamp system and which operates with a power consumption which is reduced from that power consumption at which said lamp system is rated to operate fluorescent lamps, said retrofit fluorescent lamp comprising:

an elongated tubular vitreous envelope enclosing a discharge-sustaining filling and carrying phosphor means on the inner surface thereof, substantially hollow re-entrant stem presses sealed to each end portion of said envelope and having lead-in means sealed therethrough and operatively supporting electrodes within said envelope proximate each end portion thereof, end cap means sealed to each envelope end portion and each supporting a single contact member for energizing said lamp from said lamp system, and said lead-in means electrically connecting to said single contact member, at least of one of said substantially hollow vitreous re-entrant stem presses of said lamp protruding into the space within said envelope to form cavity means of predetermined size and shape within at least one of said end portions of said envelope, and said stem press cavity means being sealed from the environment contained within said envelope:

a power-reducing capacitor means of predetermined dimensions and capacitance housed within one of said re-entrant stem press cavity means and in series circuit between the proximate electrode and the proximate single contact member, and protective device means of predetermined dimensions housed within one of said re-entrant stem press cavity means and in circuit with said power-reducing capacitor means when said lamp is normally operating, said protective device means responsive to a predetermined increase in the system operating current through said power-reducing capacitor means to effectively remove from circuit said power-reducing capacitor means, whereby said lamp system is protected from the overload conditions which can be encountered upon failure of one of said lamps of said system.

8. In a retrofit fluorescent lamp according to claim 7, said protective device comprising means for opening the electrical circuit to said first power-reducing capacitor means.

9. In a retrofit fluorescent lamp according to claim 8, said protective device comprising a current-responsive fusible element in series with said first power-reducing capacitor means and responsive to an excessive current for opening the electrical circuit to said first power-reducing capacitor means.

10. In a retrofit fluorescent lamp according to claim 8, said protective device comprising a current-responsive element in series with said first power-reducing capacitor means and responsive to an excessive current for opening the electrical circuit to said first power-reducing capacitor means and for automatically closing the circuit after a predetermined period of time has elapsed.

11. In a retrofit fluorescent lamp according to claim 7, said protective device comprising means for electrically shunting said first power-reducing capacitor means.

12. In a retrofit fluorescent lamp according to claim 11, said protective device comprising a voltage-responsive switching element connected in parallel with said first power-reducing capacitor means and which normally has a high impedance when said lamp system is operating properly, and which is responsive to a predetermined increased voltage developed across said first power-reducing capacitor means to switch to a low impedance state to shunt and effectively remove said first power-reducing capacitor means from circuit.

* * * * *

UNITED STATES PATENT AND TRADEMARK OFFICE

CERTIFICATE OF CORRECTION

PATENT NO. : 4,501,992

DATED : February 26, 1985

INVENTOR(S) : GEORGE S. EVANS ET AL

It is certified that error appears in the above-identified patent and that said Letters Patent is hereby corrected as shown below:

In the Title Page:

[*] Change "June 22, 1999" to --Mar. 6, 2001--

Claim 1, Col. 7, line 48, change "fluorscent" to --fluorescent--;

Signed and Sealed this

*Third* Day of *September 1985*

[SEAL]

*Attest:*

DONALD J. QUIGG

*Attesting Officer* *Acting Commissioner of Patents and Trademarks - Designate*